US006767283B1

(12) United States Patent
Weiss

(10) Patent No.: US 6,767,283 B1
(45) Date of Patent: Jul. 27, 2004

(54) GAMING DEVICE AND METHOD HAVING A PLURALITY OF SERIALLY DEPENDENT AND INDEPENDENT BONUSES

(75) Inventor: Steven A. Weiss, Las Vegas, NV (US)

(73) Assignee: Casino Data Systems, Las Vegas, NV (US)

( * ) Notice: Subject to any disclaimer, the term of this patent is extended or adjusted under 35 U.S.C. 154(b) by 0 days.

(21) Appl. No.: 09/660,995

(22) Filed: Sep. 13, 2000

(51) Int. Cl.[7] ..... A63F 9/24
(52) U.S. Cl. ..... 463/16; 463/25
(58) Field of Search ..... 463/10, 12, 13, 463/16, 17, 18, 19, 20, 21, 22, 25, 26, 27, 28, 30, 31, 37; 273/138.1, 139, 143 R, 461

(56) References Cited

U.S. PATENT DOCUMENTS 5,947,820 A * 9/1999 Morro et al. ..... 463/9
5,997,400 A * 12/1999 Seelig et al. ..... 463/6
6,059,289 A * 5/2000 Vancura ..... 273/143 R
6,224,482 B1 * 5/2001 Bennett ..... 463/20
6,231,442 B1 * 5/2001 Mayeroff ..... 463/20
6,234,897 B1 * 5/2001 Frohm et al. ..... 463/20
6,254,481 B1 * 7/2001 Jaffe ..... 463/20
6,290,600 B1 * 9/2001 Glasson ..... 463/20
6,364,766 B1 * 4/2002 Anderson et al. ..... 463/16
2002/0010018 A1 * 1/2002 Lemay et al. ..... 463/20
2002/0016200 A1 * 2/2002 Baerlocher et al. ..... 463/20

* cited by examiner

*Primary Examiner*—Kim Nguyen
(74) *Attorney, Agent, or Firm*—Bernhard Kreten

(57) ABSTRACT

A gaming device and method having a primary display and a plurality of symbols on the primary display which leads to a first bonus. The first bonus is a serpentine path over which a character must traverse in order to achieve a second bonus in which the character moves along in a vehicle on a road "in a movie simulation". The character stops at at least one of a plurality of mercantile establishments. A second round may be accessed from the primary game without the intervening bonus game.

7 Claims, 5 Drawing Sheets

GAMING DEVICE AND METHOD HAVING A PLURALITY OF SERIALLY DEPENDENT AND INDEPENDENT BONUSES

FIELD OF THE INVENTION

The following invention is generally related to instrumentalities known as gaming devices. More specifically, the instant invention is directed to a gaming device intended to be deployed in a casino which accepts wagering.

BACKGROUND OF THE INVENTION

Casinos and their patrons have an insatiable thirst for novelty in the gaming machines in which a player embarks upon a wagering proposition using the gaming device. More and more floor space in a casino has been devoted to gaming devices because of consumer acceptance. A player can move at one's personal pace as compared to table games and can select from an astounding array of different propositions and themes. Casino's have found gaming machines to be durable, popular and not labor intensive.

As a consequence, there is an ongoing endeavor to provide gaming machines which provide patrons with a fresh product that offers varying betting propositions and opportunities.

SUMMARY OF THE INVENTION

The instant invention is distinguishable over prior gaming devices in that the gaming premise is intuitive, the game is easy to understand and provides players with a high degree of excitement along with visual and auditory stimulus.

More particularly, the instant invention initiates with a display evocative of a mechanical reel. It may be a mechanical reel in actuality or a video depiction thereof. The reel defines a primary game which when played includes a multiplicity of paylines activated preferably as a function of the magnitude of the wager made by the player. The larger the wager the more paylines are activated. A paytable is provided which alerts the player as to which combination of symbols on the reel are recognized as worthy of providing an award should the symbols appear on a payline. Special symbols are also provided. A special symbol will immediately induce advancement to a bonus round and preferably includes an initial posting of credits associated with the initiation of the bonus event. At least one symbol is required to appear and perhaps preferably several matching symbols along a payline to trigger a bonus event.

A first bonus event involves a playing path that a simulated character such as a dog is required to traverse. The number of steps that the simulated character takes is determined by a spinner located in a video screen which the player activates, preferably by touching. In this first bonus event, preferably a certain number of spins are allocated the player. Each time the character lands on a spot on the path which correlates to a credit value, that credit value is posted to the player's account. In addition, along the playing path are spaces which, if the character advances and stops thereat, signals the end of the bonus event. These spaces which indicate the end of the bonus event are entitled "Go Home". Should the player advance the character to the terminus of the playing path, a second bonus round evolves, known as "Easy Street".

In addition, the symbols on the reel may allow the player to advance directly to the second bonus round, Easy Street, without the intervening first bonus round where the character advances along a path. In any event, the player, at the threshold of Easy Street sees the on screen character in a vehicle traveling down a road having a plurality of mercantile establishments along the road. The character's vehicle stops at one of the establishments for a final determination of the player's second bonus for the posting of further credits. The character and vehicle may stop at an establishment as a function of a random operation associated with the processor, or may be designated by the player by touching an appropriate decision making button on the display. Once the character has stopped at the chosen establishment, a final posting of additional credits due the player is incremented on a credit meter and the second of the two bonus rounds is terminated whereupon the player is prompted to play again.

OBJECTS OF THE INVENTION

Accordingly, it is a primary object of the present invention to provide a new and novel gaming device and method.

It is a further object of the present invention to provide a device and method as characterized above which is relatively intuitive to understand, has eye appeal and provides enhanced enjoyment.

It is a further object of the present invention to provide a device and method as characterized above which is readily recognizable and lends itself to standardization so that the same game at various machines can be readily identified.

It is a further object of the present invention to provide a device and method as characterized above which allows a player the opportunity to advance serially to a plurality of bonus events and also to engage the bonus events not in series.

Viewed from a first vantage point, it is an object of the present invention to provide a gaming device, comprising, in combination: wager accepting means, a display, means for operating said display as a function of activating said wager accepting means, a primary game on said display having particular outcomes thereon, and first and second bonus games, both of said games are accessed via said particular outcomes on said primary game, said first bonus game includes means to play said second bonus game.

Viewed from a second vantage point, it is an object of the present invention to provide a gaming device, comprising, in combination: wager means, a display, a processor and random generator means coupled to said wager means and said display to generate a primary game on said display upon activation of said wager means, a first bonus game enabled by a certain outcome from said primary game, and a second bonus game enabled by a certain outcome from said first bonus game.

Viewed from a third vantage point, it is an object of the present invention to provided a gaming method, the steps including: accepting a wager, displaying a primary game, providing a primary game outcome which leads to a first bonus game, and providing a first bonus game outcome which leads to a second bonus game.

These and other objects will be made manifest when considering the following detailed specification when taken in conjunction with the appended drawing figures.

DESCRIPTION OF PREFERRED EMBODIMENTS

Figure 1:
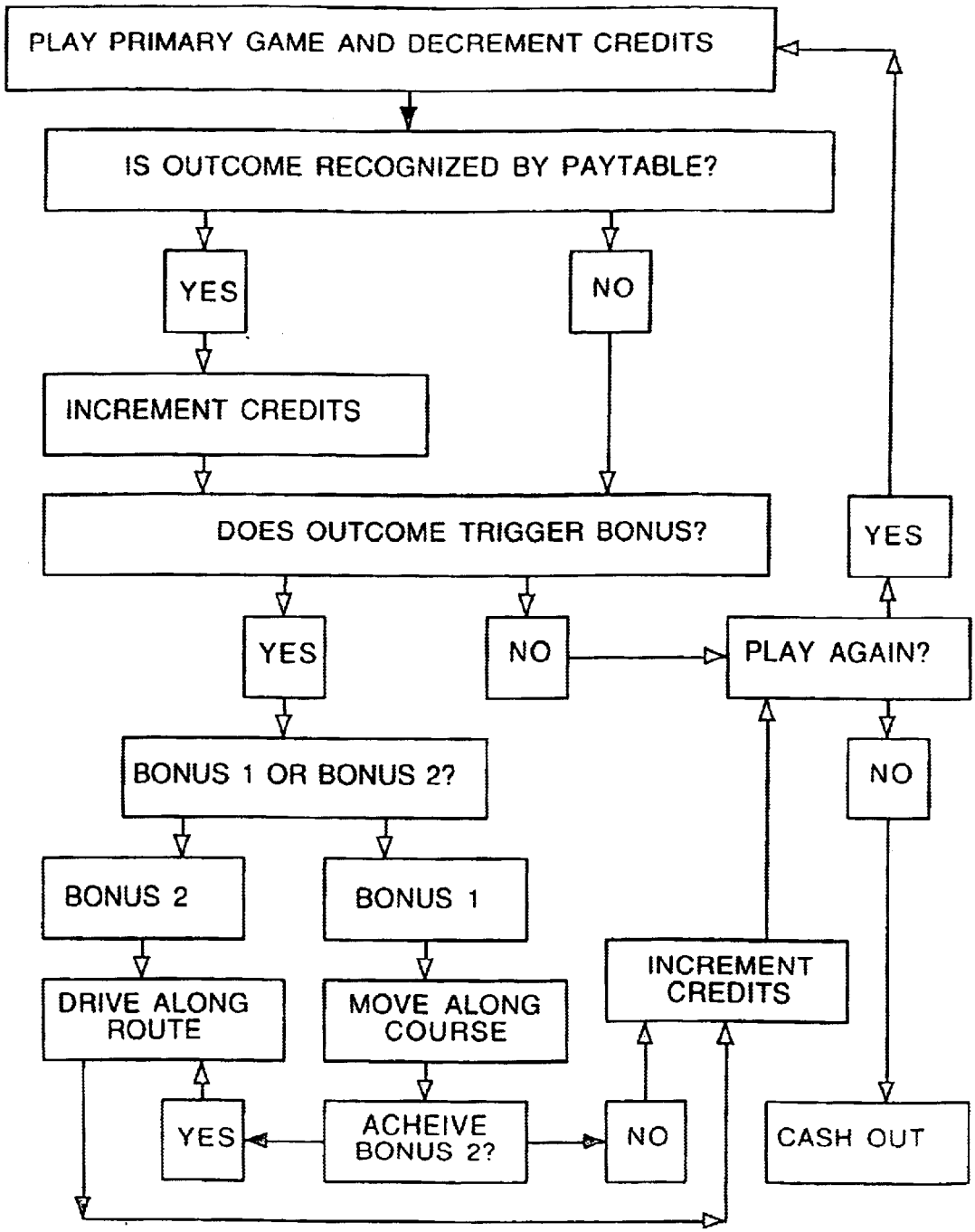
FIG. 1 is a flow chart depicting the methodology associated with the instant invention.

Referring to the drawings, wherein like reference numerals denote like parts throughout, reference numeral 10 is directed to the gaming machine according to the present invention.

Figure 2:
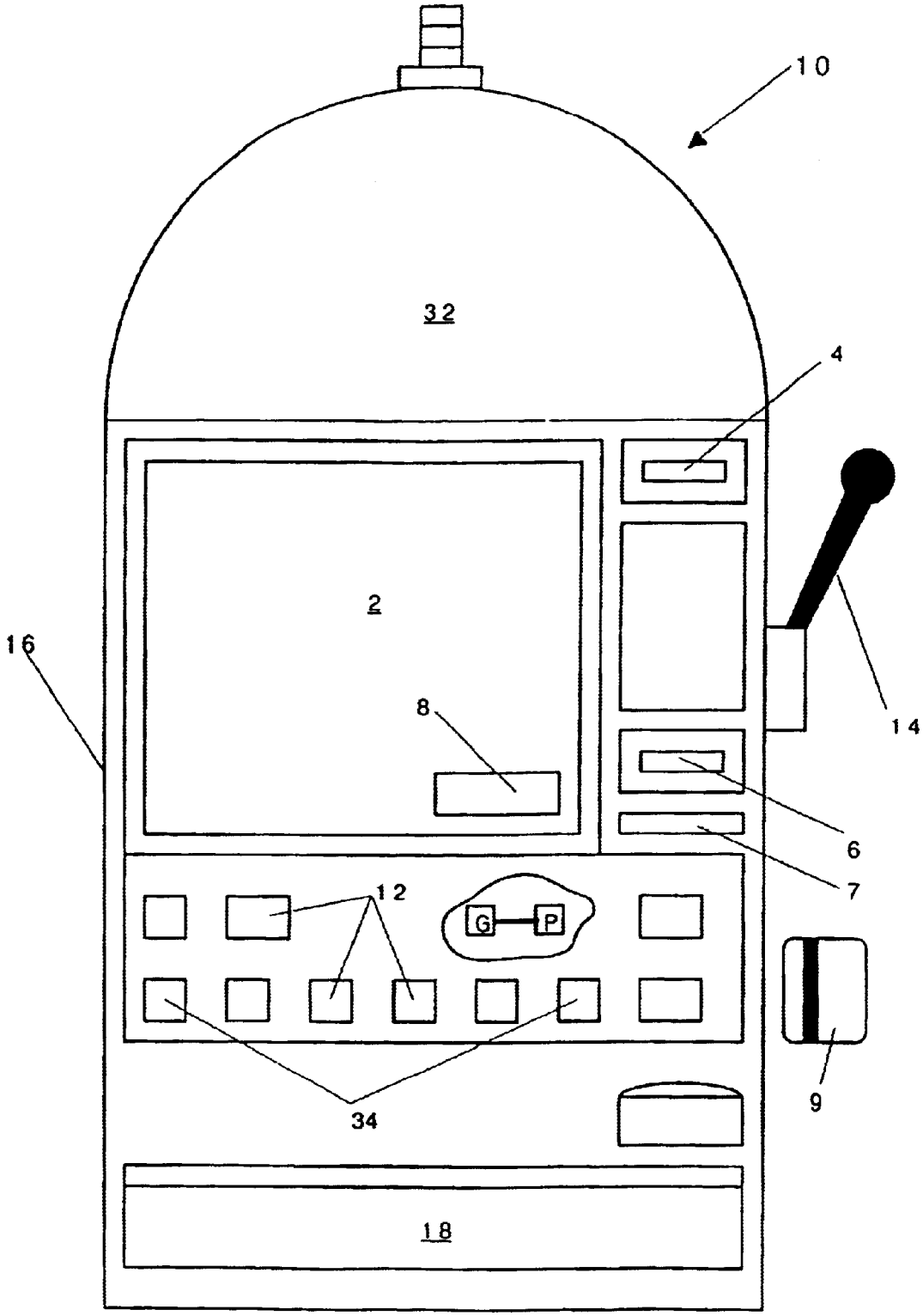
FIG. 2 is a gaming machine which lends itself to deployment of the game thereon.

In its essence, the device 10 includes a housing 16 which supports a visual display 2, preferably a video monitor, therewithin (FIG. 2). The display 2 may include a window 8 for special messages or for incrementing counting of credits accumulated by the player. The device also includes an LED or other readout 4 for prompting the player and can provide similar verbiage as the window 8 or in lieu thereof, to stimulate the player. The device includes an inlet 6 for the reception therein for coins, currency or the like to auger in the inception of play. A separate slot 7, capable of accepting and dispensing encoded moveable media 9 such as a smart card, is also present. A plurality of decision-making buttons 12 are located on the face of the apparatus 10, preferable below the display 2 and a pull handle 14 can be used to initiate play or as an alternative to supplement the decision-making buttons 12. A coin hopper 18 may be included to effectuate an output of an award due the player. The device 10 may have a top portion 32 with a display thereon having a motif correlative with the game to be played and can include a paytable. A plurality of speakers 34 may be included on the device for aural interaction with the player. The apparatus also includes a processor P coordinating all functions and a random number generator G operatively coupled thereto for generating outcomes.

Figure 3:
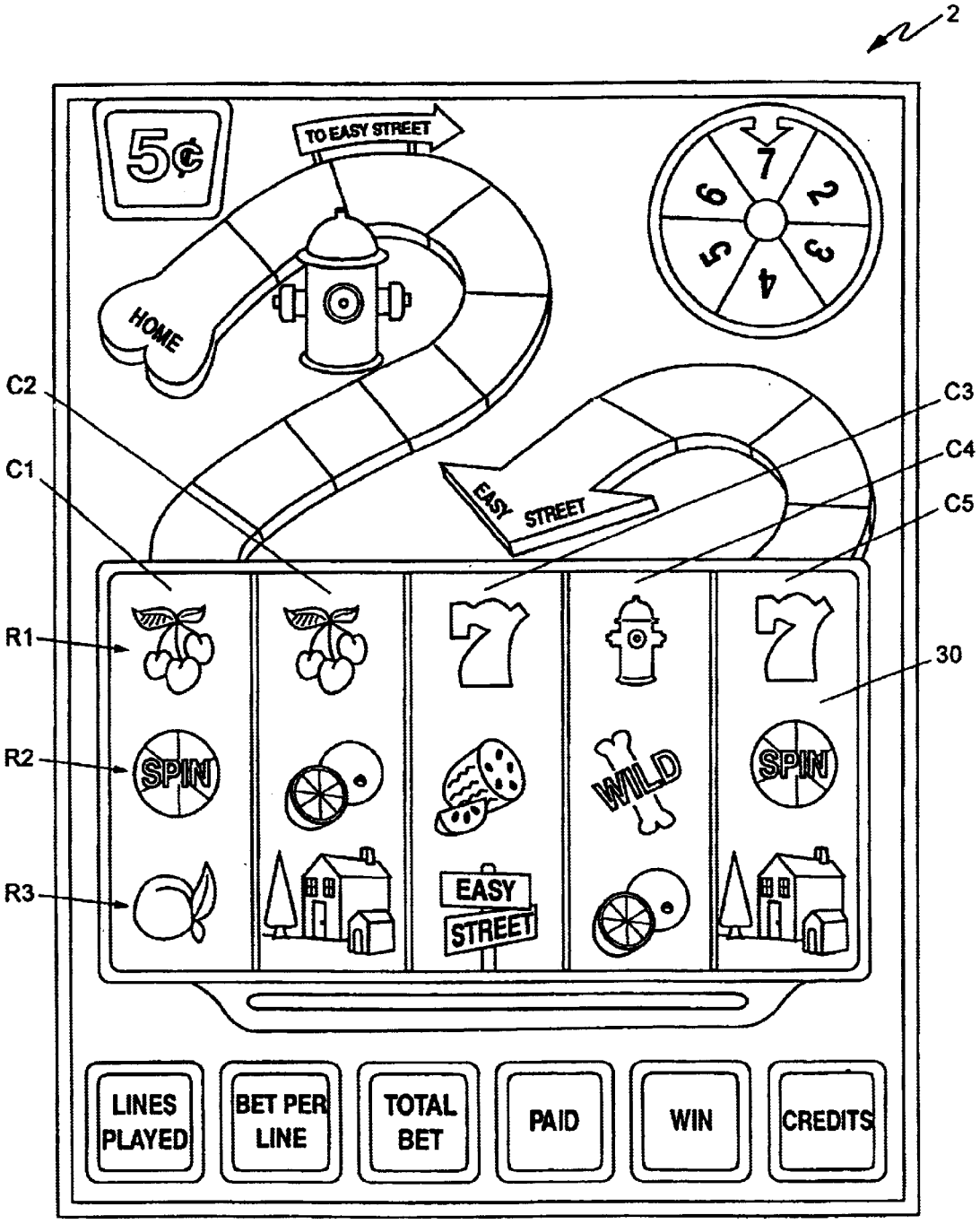
FIG. 3 is a first screen associated with the game defining a primary game.

Referring now to FIG. 3, the display 2 includes a 3×5 matrix 30 having five columns $C_1$ through $C_5$ and three rows $R_1$ through $R_3$. Although a 3×5 (R×C) matrix is shown, there may be fewer or more rows than columns as should be evident to one skilled in the art having been informed by the present disclosure. Each of the columns is simulative of a reel or may actually be contoured as a mechanical reel and the reels are capable of independent rotation. A plurality of paylines are associated with the rows, with the conventional paylines being row 1, row 2 and row 3, although non-linear paylines can also be enabled as is now evident to one skilled in the art informed by the present disclosure. Each reel includes a plurality of symbols, one of which is oriented with a respective row. Upon appropriate alignment of a plurality of matching symbols, those symbols when matched and that correspond to a paytable typically located on a glass 32 at the top of the machine will engender an award based on the correspondence of those symbols to the paytable. A random number generator G driven by processor P (FIG. 2) causes the outcomes that appear on the reel 30 to randomly occur and to denote the presence of symbols which are recognized by a paytable. The display 2 is preferably one that includes touch screen capabilities and at the bottom of the display 2 simulative buttons for lines played, bets per line, total bet and tabulations of paid amounts, won amounts and credits posted are visually accessible to the player. In the background of the reel matrix 30 and on the display 2 is a portion of a first bonus which can be achieved should an appropriate symbol or symbols appear on the reel mechanism 30. For example, the symbol simulative of a dog bone bearing the nomenclature "wild", when present on a payline, could trigger the first bonus. It may be required that more than one wild symbol be present on one payline or by other means in order to achieve the first bonus round.

Figure 4:
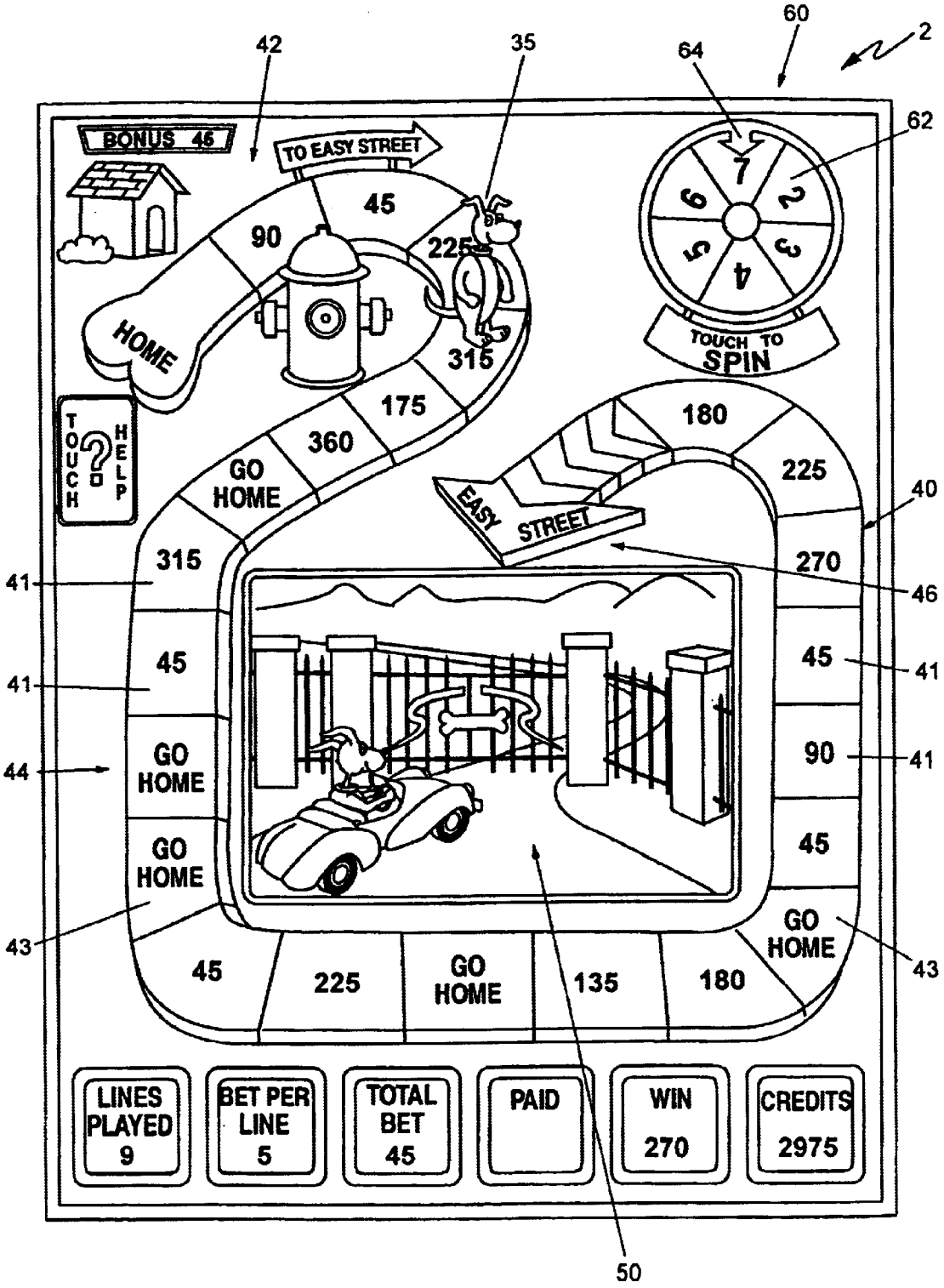
FIG. 4 is a screen depicting a first bonus game.

Referring to FIG. 4, assume that the first bonus round has been enabled whereupon the reels 30 are removed from the screen and the full depiction of the first bonus game is revealed to the player. The first bonus round is defined by a playing path or course 40 having an arcuate top portion 42 which begins in the upper left-hand corner of the display 2 which leads to a rectangular lower portion 44. The rectangular lower portion 44 frames by circumscribing a depiction of the second bonus 50 with the rectangular lower portion 44 having an arrow shaped terminus 46 pointing to a top medial edge of the second bonus 50. The playing path 40 includes a plurality of segmentations which define spots 41 on the path with each spot having differing numerical values. As a character 35 moves along the path, it lands on spots 41 as directed by a spinner 60 located in the upper right-hand corner of the display 2. When the spinner 60 is touched, a disc 62 rotates. When the disc comes to rest, one sector of the disc 62 aligns with a pointer 64 indicating how far the character is to advance along the path. So long as the character 35 lands on spots 41 having a numerical indicator, additional credits are posted to the player's account correlative with the magnitude of the numerical indicator on the spot. Should the character 35 be directed to a space 43 on the playing path that bears the nomenclature "go home", the first bonus round is over and the game returns back to its normal playing status described with respect to FIG. 3. The player is then prompted to play again if desired and if not, the player can cash out as indicated by the flow chart of FIG. 1.

Figure 5:
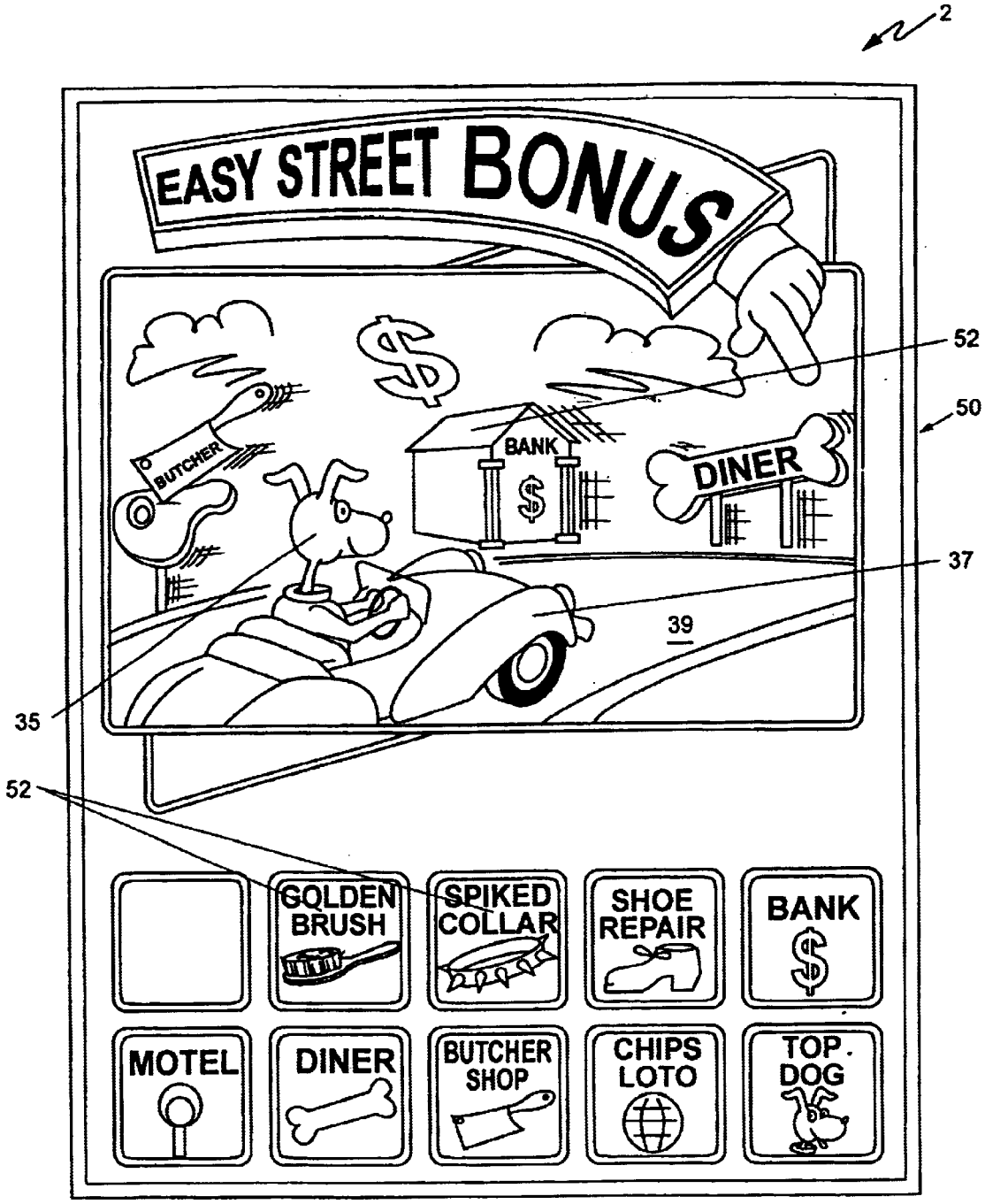
FIG. 5 is a screen depicting a second bonus game.

Assume that the character 35 has traversed the path 40 by exclusively landing on spots 41 having numerical values which increment and are posted as credits to the player's benefit, and then arrives at the terminus 46 of the first bonus round. In this event, the player then moves into the second bonus 50 shown in the center of FIG. 4. The display 2 is then transformed into the FIG. 5 depiction of the second bonus 50. FIG. 5 reflects the character 35 in a vehicle 37 moving down a road 39 and bypassing a plurality of establishments 52. Each establishment has a different identity along the road which correlates with depictions at the bottom edge of the display 2. Thus, the character 35 has an opportunity to stop at establishments such as the golden brush, the spiked collar, the shoe store, the bank, the motel, a dinner establishment, a butcher shop, chips loto or top dog. The character 35 stops in front of the establishments which signifies another credit award. The character 35 may stop at one of the establishments as a function of the processor, or the stop may be controlled by the player pushing one of the buttons 52 on the screen. More than one stop may be permissible. The award, once posted, allows the player to reinitiate the game and upon receipt of further wagers, return to the FIG. 3 screen.

It is also possible, when viewing FIG. 3, to move directly to the second bonus should the symbol Easy Street shown in FIG. 3 appear on a payline or, more likely, a series of Easy Street symbols appear on a payline. Thus, in some cases, the first bonus round shown and described with reference to FIG. 4 may be avoided with the player moving directly to the second bonus.

Moreover, having thus described the invention, it should be apparent that numerous structural modifications and adaptations may be resorted to without departing from the scope and fair meaning of the instant invention as set forth hereinabove and as described hereinbelow by the claims.

I claim:

1. A gaming device, comprising, in combination:

wager accepting means, a display, processor means for operating said display as a function of a player activating said wager accepting means by placing a wager, a primary game on said display having a first and a second particular outcome thereon, and first and second bonus games, said first bonus game is accessed via said first particular outcome on said primary game, and said second bonus game is accessed by said second particular outcome, and said first bonus game is embodied as a pathway and includes an outcome at a terminus of said pathway to play said second bonus game.

2. A gaming device, comprising, in combination:

wager means, a display, a processor coupled to said wager means to activate a random generator means to generate a primary game on said display upon activation of said wager means, a first bonus game enabled by a certain outcome from said primary game, and a second bonus game enabled by a certain outcome from said first bonus game wherein said second bonus game is also accessed by an outcome from said primary game and wherein said first bonus game is defined by a path which is to be traversed, spots on said path resulting in credits should a player land thereon and a terminus of said path leading to said second bonus.

3. The device of claim 2 wherein spaces are provided on said path which end said first bonus game should the player land thereon.

4. The device of claim 3 wherein said second bonus game includes a road upon which a vehicle travels and plural establishments along said road, and the player is awarded credits when the vehicle stops at an establishment.

5. A gaming method, the steps including:

accepting a wager, displaying a primary game, providing a primary game first outcome which leads to a first bonus game embodied as a pathway, providing a first bonus game outcome at a terminus of said first bonus game pathway which leads to a second bonus game embodied as a pathway and providing a primary game second outcome which leads to said second bonus game and bypasses completely said first bonus game.

6. A gaming method, the steps including:

accepting a wager, displaying a primary game, providing a primary game first outcome which leads to a first bonus game, said first bonus game embodied as a pathway having positions to award credits when landed on, providing a first bonus game outcome at a terminus of said first bonus game pathway which leads to a second bonus game, said second game embodied as a pathway and providing a primary game second outcome which leads to said second bonus game.

7. A gaming device, comprising, in combination:

wager accepting means, a display, processor means for operating said display as a function of a player activating said wager accepting means by placing a wager, a primary game on said display having particular outcomes thereon, and first and second bonus games, both of said bonus games are accessed via said particular outcomes on said primary game, wherein said first bonus game is embodied as a path to be traversed, said path including spots to award credits, and a terminus of said first bonus game includes means to play said second bonus game.

* * * * *